United States Patent [19]

Bucher

[11] Patent Number: 4,799,517

[45] Date of Patent: Jan. 24, 1989

[54] WEFT YARN STORE FOR A LOOM

[75] Inventor: Robert Bucher, Frick, Switzerland

[73] Assignee: Sulzer Brothers Limited, Winterthur, Switzerland

[21] Appl. No.: 41,097

[22] Filed: Apr. 22, 1987

[30] Foreign Application Priority Data

Apr. 29, 1986 [CH] Switzerland ..... 01754/86

[51] Int. Cl.[4] ..... D03D 47/36

[52] U.S. Cl. ..... 139/452; 242/47.01

[58] Field of Search ..... 139/452; 242/47.01, 242/47.12, 47.13

[56] References Cited

U.S. PATENT DOCUMENTS 4,516,611 5/1985 Mimura et al. ..... 139/452
4,627,474 12/1986 Tholander ..... 139/452
4,651,786 3/1987 Griffith ..... 139/452

FOREIGN PATENT DOCUMENTS 137 1/1983 World Int. Prop. O. ..... 139/452

*Primary Examiner*—Henry S. Jaudon

*Attorney, Agent, or Firm*—Burns, Doane, Swecker & Mathis

[57] ABSTRACT

A weft yarn store (1) for looms (3) stores weft yarn (2), the yarn coming from a package disposed outside the store, on a stationary drum (13) having a first winding zone (135) and a second winding zone (136). While a first winder (12) winds yarn (21) on to a first winding zone (135) so that a yarn supply (21) is permanently available, the second winder (14) intermittently or variably unwinds yarn from the first winding zone towards a second winding zone (136). In a preferred operation of the store (1) together with a loom (3), yarn which is from the second winding zone (136) and which was deposited there by the second winder (14) is picked into the loom. After consumption of this supply and until the termination of the same pick, yarn is unwound directly from the supply in the first winding zone (135) by means of the second winder (14) and supplied to the loom (3) without intermediate storage. The second winder (14) is driven by an electric motor (144) whose operation is controlled by a control facility (15). Picking at low yarn tensions and with accurate metering of weft yarn length is therefore possible.

17 Claims, 4 Drawing Sheets

15
145
144
148
147
149a
149
146
III
III
17
2
23
21
13
12
12
126
2
11
147
149
148
148
146
11

WEFT YARN STORE FOR A LOOM

FIELD OF THE INVENTION

The invention relates to weft yarn store methods and apparatus for receiving weft yarn drawn off a supply package and delivering the weft yarn for picking into a loom. In an air jet loom, for example, the weft yarn extends continuously from a yarn supply package, through a storage facility which disposes an appropriate length of the yarn in condition for quick delivery, and on to air jet means which operates to move the free end portion of the yarn across the shed.

BACKGROUND OF THE INVENTION

In the past considerable attention has been given to various aspects of yarn store apparatus and methods, and numerous proposals have been advanced. Nevertheless, even further improvements still are being sought.

One area of interest relates to tension in the weft yarn when a picking movement is brought to an end abruptly. For example, in an air jet loom the weft yarn end is blown very rapidly across the shed, and the yarn movement ordinarily is stopped quite suddenly after the predetermined pick length has been inserted. The tension spikes which occur at such movements can be sufficiently high to damage the yarns and cause flaws in the weaving.

Another area of interest relates to controlling pick length, that is, to controlling the metering function of a yarn store so that reasonably fine adjustments in pick length can be made in response to sensed operating conditions in the loom. When a yarn store delivers too great a length for a perfect pick, the excess is wasted and may even cause a fault. When a yarn store delivers a length too short for a perfect pick, the integrity of the edge portion (selvage) of the fabric being woven may be affected adversely.

Of course, these factors also have to be considered within the context of many practical limitations which are placed upon the design of yarn stores for modern high speed looms. Speed and reliability of operation cannot be sacrificed materially in the search for more refined performance.

SUMMARY OF THE INVENTION

It is an object of this invention to provide a method of supplying yarn and a weft yarn store therefor which ensure very gentle picking and accurate adaptation of weft yarn length.

In the present invention, the weft yarn being drawn off a package is, through the agency of a first winder, received for intermediate storage on a drum in the form of a number of turns in a first winding zone as a first supply. A second winder is controllably rotatable about the drum and interposed between the first supply and the picking means of the loom. Yarn may be unwound from the first supply by the second winder. Under some circumstances the unwound yarn becomes immediately available for delivery to the loom and in other circumstances may be wound onto a second winding zone to provide a second supply for later delivery to the loom.

A feature of the invention is that the rate of yarn removal from the first supply is reduced before the end of picking in accordance with a predetermined programme. In this case, the rate of yarn removal can be reduced steplessly to zero or to a value which is low in relation to the picking rate. In this latter case picking is terminated by the supply of yarn to the loom being blocked by braking means which presses the yarn against a surface of the drum at a location between the second winder and the loom. Before new formation of the second supply, the weft yarn must be retained after the second winding zone as considered in the direction of yarn removal.

As regards yarn transfer from the first supply to the second supply, the operation can proceed at a constant maximum yarn speed. Alternatively, the rate of yarn transfer can increase continuously during at least an initial part of a picking operation, so as to reach a value comparable to the rate of weft consumption during picking shortly before exhaustion of the second supply.

The total metered length of weft yarn is checked in the loom after picking, whereafter in the event of deviation from a set value, the operating programme for the second winder is adjusted to offset the deviation.

In the weft yarn store, at least the second winder has a drive which can be programmed for commencement time and for speed. This drive comprises a controlled electric motor and an associated control facility. The first winder can be driven independently of the second winder provided that a particular quantity of yarn supply in the first zone is not undershot. However, the two winders can be rigidly interconnected.

When the drive of the second winder is controlled by the method described, picking is gentle. More particularly, abrupt retardation of the weft yarn at the end of picking can be avoided, since, near the end of picking, the second winder operates at a continuously decreasing angular velocity and, during this time, the picking rate is controlled by the second winder. Hence, the picking rate can be reduced in a controlled manner.

The system is of use for picking various weft yarns in a loom since the second winder can be brought into operation in any kind of weaving cycle. When a number of colored wefts are being picked, a corresponding number of yarn stores according to the invention should be provided.

BRIEF DESCRIPTION OF THE DRAWINGS

The invention will be described in detail hereinafter with reference to the drawings wherein.

DETAILED DESCRIPTION OF PREFERRED EMBODIMENTS

Figure 1:
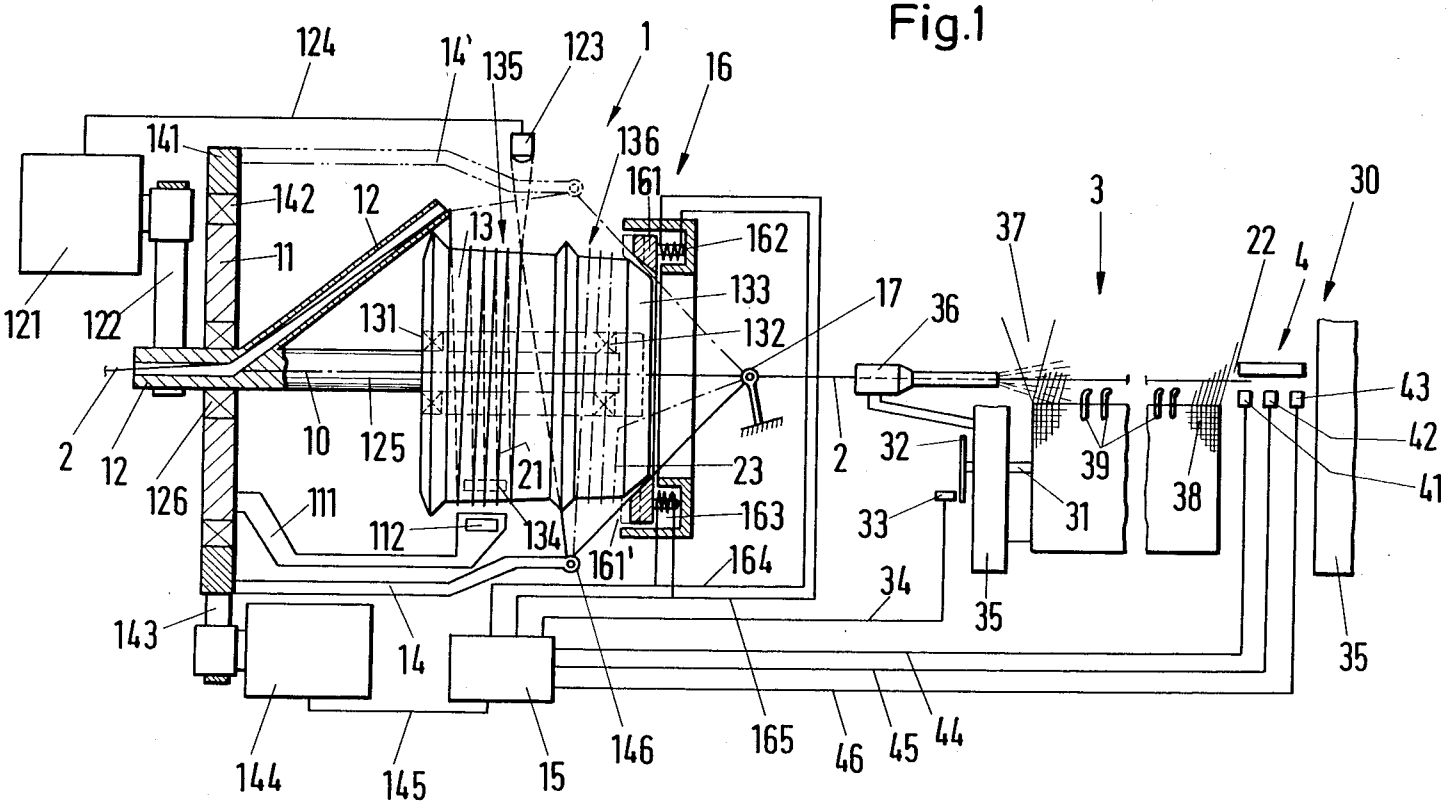
FIG. 1 shows schematically at the right hand side a loom on a reduced scale and illustrates at a larger scale a weft yarn store according to the present invention having two winders with separate drives.

A first winder 12 is so mounted by means of a bearing 126 carried by a casing or stationary frame member 11 of a weft yarn store 1 as to be freely rotatable and is driven by way of a belt drive 122 by a drive 121, for example, a frequency-controlled electric motor. A supply detector or sensor 123 controls the drive 121 by way of a line 124. When there is not enough yarn in weft yarn supply 21 to reach the predetermined amount sensed by the detector 123, the drive 121 comes into operation so that the first winder 12 can draw weft yarn 2 off a package (not shown) and wind such yarn around the periphery of a drum 13 in a first winding zone 135 until the detector 123 senses that the desired supply has been achieved at which time the drive 121 will stop. The drum 13 is mounted on winder spindle 125 by way of bearings 131, 132. To prevent rotation of the drum 13, the drum has in its interior a steel insert 134 disposed in the operative range of the magnetic field of a magnet 112, the same being stationary on an arm 111 and being connected to casing 11.

Independently of the first winder 12, a second winder 14 is rotatably mounted by way of bearings 142 on the frame or casing 11. Through the agency of a pulley 141 and belt 143 the winder 14 can be rotated by an electric motor 144 around spindle 10 of store 1, the weft supply 21 decreasing since eye 146 of second winder 14 transfers the weft yarn 2 to a second winding zone 136. The second winder remains in operation until the end of picking so that the rate of drawoff of the weft yarn is reduced smoothly to zero before the termination of picking. To the right of conical end 133 of drum 13 in FIG. 1, a yarn brake 16 is disposed. It has a conical braking ring 161 which can move axially towards the drum 13. When the brake is actuated, the ring 161 is moved relative to the stationary frame or casing component 162 by means of an electromagnet 163, to bring the ring 161 towards the conical end 133 of the drum 10, so that the weft yarn is stopped or retained near the conical end 133. The brake is on when the ring 161 is in the position 161' shown in chain-dotted line.

Operation of the brake 16 must be coordinated with the operation of the second winder 14 in order to assure proper yarn handling. If the brake were applied when the winder 14 was rotating very rapidly, there would a danger of weft yarn backing up between the eye 146 and the ring 161. After the second winding zone 136 has been emptied of yarn during a pick, the brake 16 must be switched on before there can be further formation of weft yarn supply in the second winding zone by the second winder 14.

A picking nozzle 36 secured to loom frame 35 comes into operation at intervals to draw weft yarn off the drum 13, and the weft yarn is picked into shed 37, the yarn being supported in its extended position by auxiliary nozzles 39 positioned at intervals across the shed. After picking, the weft yarn is beaten up to the edge or fell of the cloth 38 being woven.

Operation of the store 1 is coordinated with the loom 3 by a control facility 15 which, through the agency of a reader 33, reads the angular position of loom main shaft 31 by way of a line 34. The facility 15 is connected by way of a line 145 to a controllable electric motor 144 controlling the second winder 14.

Also, the facility 15 has, by way of lines 44, 45 and 46, a connection to detectors 41, 42 and 43 on the taking or receiving side of the loom opposite the side at which the jet 36 is located. The detectors 41–43, which detect the position of weft yarn end or tip 22, will hereinafter be referred to as picking detectors 4. Initially, the facility 15 will be set to drive the winder 14 for a time and at a rate to provide the weft yarn length which is theoretically required for a pick. However, this may be a little too short and the weft yarn may only just reach the first detector 41. To form a proper selvedge on the catching side of the loom on the right in FIG. 1, such a position of the weft yarn tip would not be optimal. Because of this position of the tip 22, the facility 15 would automatically cause a slight adjustment in the operation of the motor 144 so that in the immediately ensuing or one of the subsequent unwinding operations more yarn would be removed from supply 21 and, correspondingly, the tip 22 would reach the central detector 42. So that adjustment of the position of the weft yarn tip after picking toward the detector 42 can be set up rapidly, a third detector 43 can be provided which detects variations in the sense of excessive weft yarn length.

It should be noted the adjustment possibilities for controlling weft length are not step-wise in nature. Rather there is continuity over the range of adjustment, with very small changes in timing or speed of motor (144) operation being possible, to enable precise control of pick length.

If the second winder 14 starts only at the beginning of a picking period, the nozzle 36 being in operation and the brake 16 being off, rotation of the second winder cannot form any supply of weft yarn in the second winding zone since the weft yarn 2 is drawn off immediately. When the second winder operates thus, picking in air jet looms can be supervised similarly to picking in gripper looms, the position of the weft yarn tip 22 during picking through the shed 37 being known at any instant of time. Consequently, auxiliary nozzles 39 for further conveyance of the weft yarn through the shed can be so brought into and out of operation as to obviate unnecessary consumption of air.

Conveniently, to thread the weft yarn into the store 1 the first and second winders are moved into positions in which they are in alignment with one another. For example, and as shown in FIG. 1, the first winder is retained in the solid-line position, in which event the second winder 14 takes up the chain-dotted-line position 14' shown in FIG. 1. The weft yarn 2 can then be readily threaded from the exit aperture out of the first winder 12 into the eye 146 of the second winder 14. In this case, before the store starts to operate or before the loom is started, the winder 12 must form a yarn supply 21 in the first winding zone 135, whereafter the second winder 14 can start up.

Figure 2:
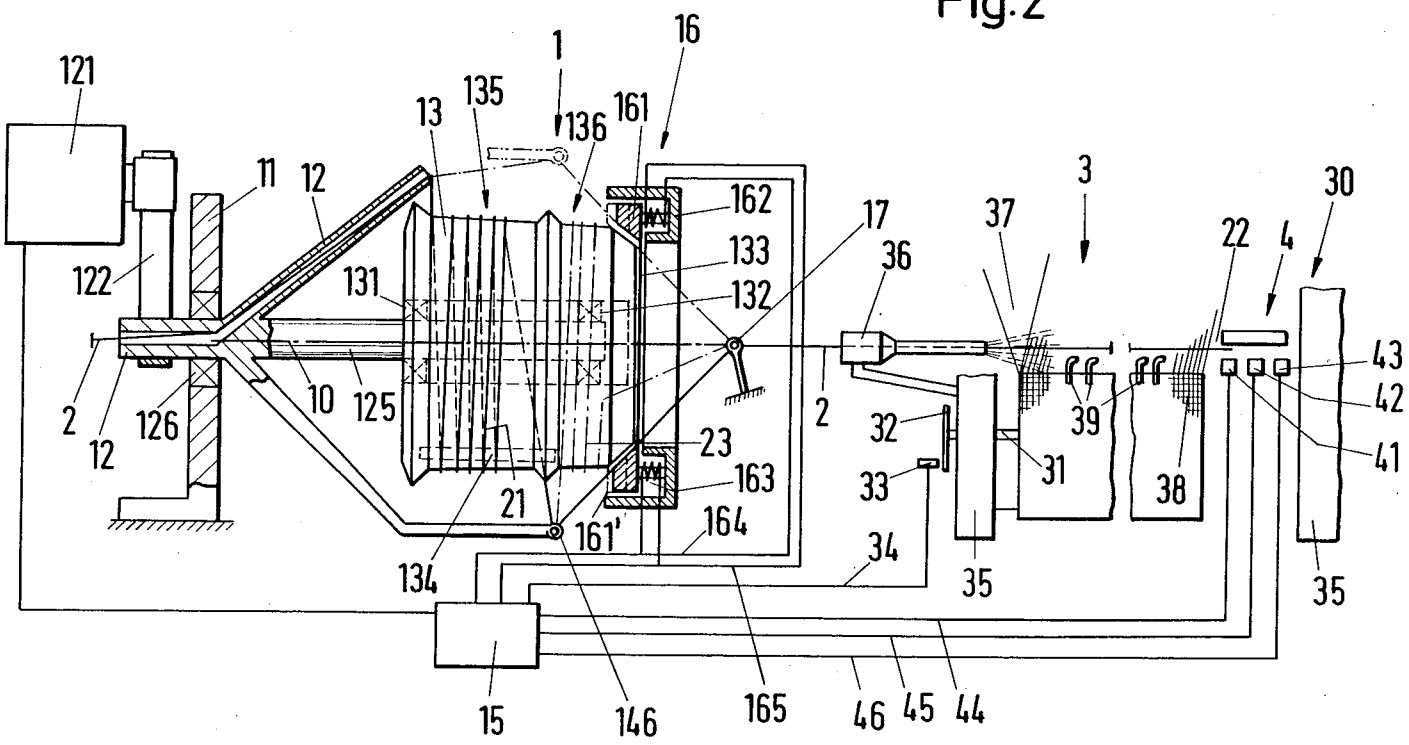
FIG. 2 is a similar view but shows a weft yarn store according to another embodiment of the invention having two rigidly interconnected winders.

FIG. 2 shows a weft yarn store for performing the method according to the invention with the use of a common drive for the first and second winders. In this embodiment the drive 121 takes over the function of the drive 144 as hereinbefore described. In this embodiment of a yarn store, the yarn sensor 123 can be omitted since the first winder always "tops up" with as much yarn as the second winder draws off, so that the yarn supply 21 does not vary in operation. The drum 13 is prevented from rotating in this case by means of an enlarged steel insert 134 which acts by gravity and without any additional magnetic effect to stabilize the position of the drum.

Figures 3A, 3B:
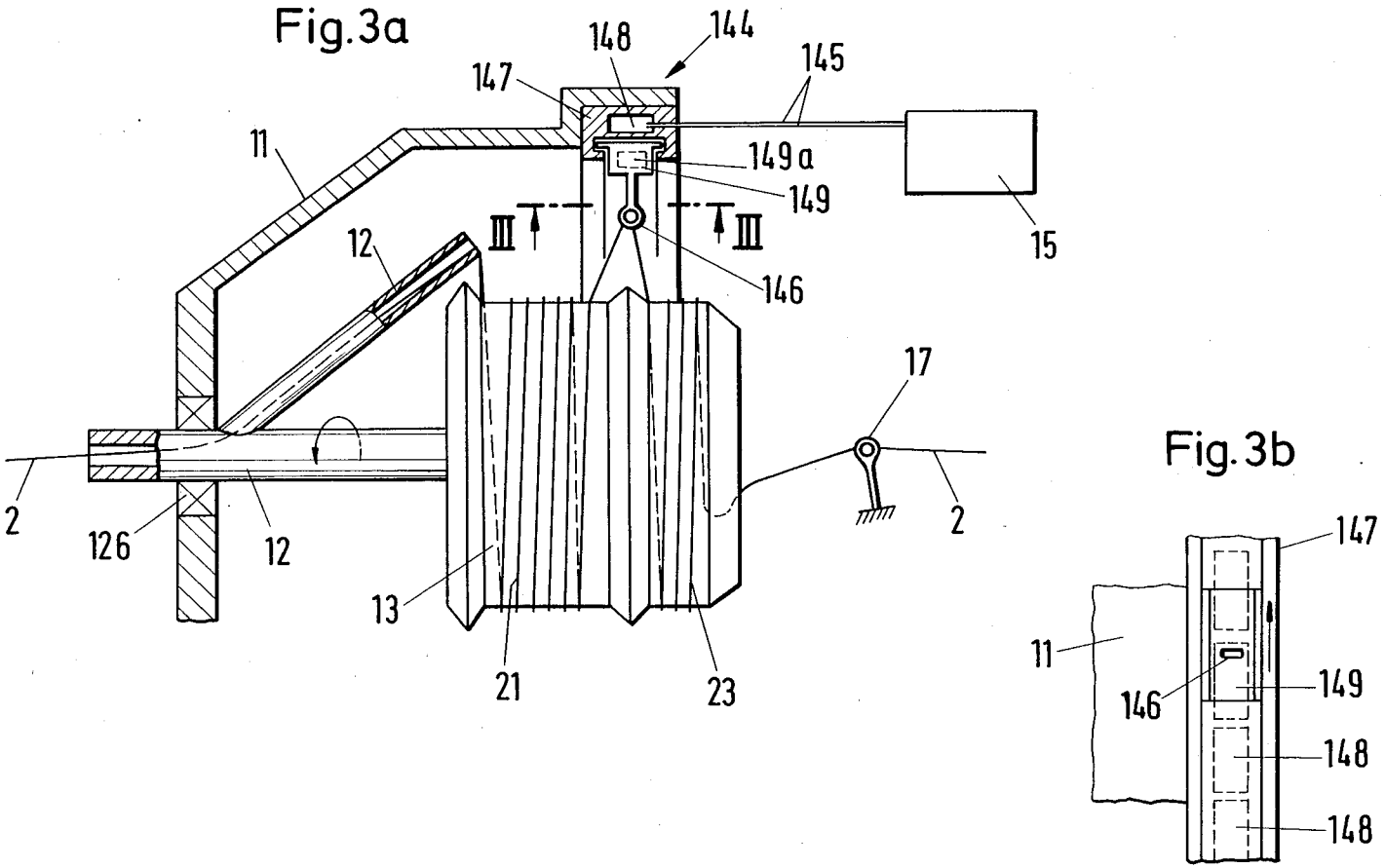
FIGS. 3*a* and 3*b* illustrate a weft yarn store having an alternative form of drive for the second winder.

FIG. 3*a* shows a drive 144 for a second winder 146 of particularly low weight. A ring 147 is let into the casing 11 and electrical windings 148 are distributed around the periphery of the ring 147. Through the agency of the control facility 15 and of lines 145, magnetic fields can be produced in the windings and act on a magnetic insert 149*a* in a rotor 149 guided in the ring 147. The magnetic fields thus exert acceleration or deceleration or carrying forces on the rotor 149. The eye 146 on the inside of the rotor 149 unwinds yarn from the first yarn supply 21. The rotor 149 of this embodiment takes the place of the second winder 14 and is controlled in the same way as the latter.

Figure 4A:
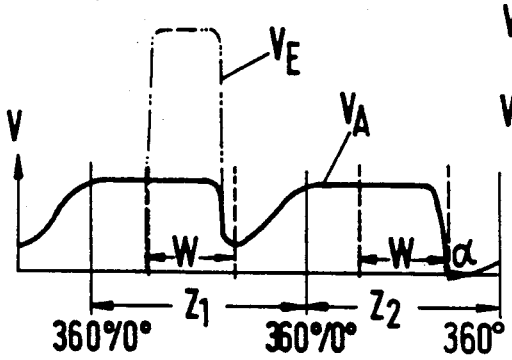
FIGS. 4*a*, 4*b*, 5 and 6 illustrate speed diagrams of the second winder for various forms of winder drive control.

Referring to FIG. 4a, speed patterns $V_A$ and $V_E$ are plotted against the angle $\alpha$ of loom rotation. $V_A$ represents the rate of removal of weft yarn from the first supply and is merely the peripheral speed of the second winder as measured on the drum periphery. During the picking period W the weft yarn is picked into the shed at the speed $V_E$. During a loom cycle such as $Z_1$ or $Z_2$, there is in each case a yarn transfer from the first winding zone in accordance with the speed pattern or profile $V_A$. While the supply is being formed in the second winding zone 136 at a constant maximum rate of weft yarn removal, picking starts. The picking period has the reference W. In a first approximation the speed pattern $V_E$ of the yarn being paid off towards the loom 3 by the nozzle 36 corresponds to a rectangle. The steep increase in speed is the result of air being applied to the nozzles 36 and 39, while the reason for the abrupt decrease in speed near the end of the picking period W is that the yarn supply in the second winding zone 136 has been exhausted. The weft yarn is then picked into the shed 37 only at the maximum removal rate $V_a$. At this instant of time the removal rate starts to decrease in accordance with the speed pattern $V_a$ because of the programme in the control facility 15.

As can be gathered from FIG. 4a, the speed $V_A$ drops to only a predetermined value at the end of picking. The weft yarn brake 16 must close at this instant of time to mark the end of picking clearly. The speed $V_A$ is then immediately increased to a maximum so that the second winder 14 starts to form a supply in the second winding zone 136. In case of an interruption of the weaving operation during cycle $Z_2$, speed $V_A$ drops to zero.

Figure 4B:
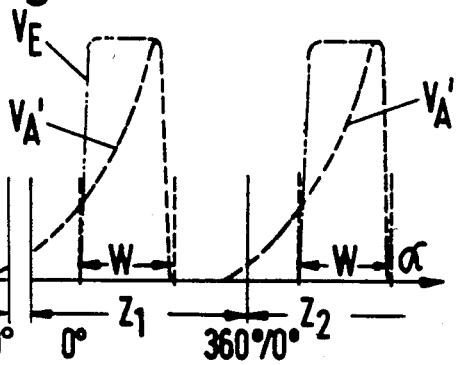

FIG. 4b shows another possible way of operating the weft yarn store. The removal speed $V_A'$—i.e., the winding speed of the second winder 14—increases continuously in this case from zero to a value close to the maximum speed at which the weft yarn is picked into the shed 37, so that the abrupt speed decrease associated with exhaustion of the yarn supply in the zone 136 is less pronounced than in the operation in accordance with FIG. 4a. The effect of the controlled decrease in the speed $V_A'$ near the end of the picking period W is that the weft yarn is stressed less than in the other form of operation mentioned. According to the speed pattern $V_A'$ shown in FIG. 4b, the removal rate decreases to the value zero, wherafter the yarn brake 16 must close before the removal rate starts to rise again.

The illustrations given in FIGS. 4a and 4b apply to single-picking operation with only a single weft yarn store 1 available on a loom 3. However, the invention is applicable also to looms in which there are multiple yarn supplies and multiple weft yarn stores associated therewith.

Figure 5:
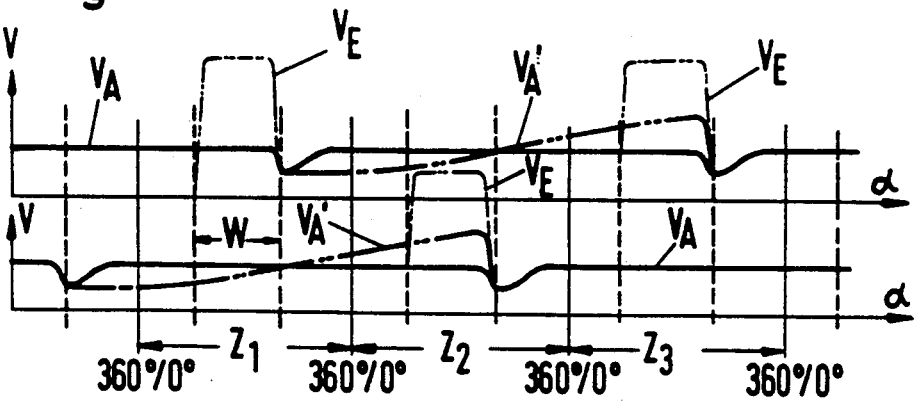

FIG. 5 shows the common operation of two weft yarn stores on a loom in so-called mixed changing. With such an operation, the yarns from the two stores will alternate with one another in the fabric being produced. As the upper diagram in FIG. 5 shows, one store delivers weft yarn to the loom during the cycle $Z_1$; during the cycle $Z_2$ and at the start of the cycle $Z_3$ yarn is stored again, whereafter weft yarn is drawn off the first store in cycle $Z_3$. The end of picking always coincides with the abrupt decrease in the yarn removal speed $V_A$ at the end of a storage step. The second store, whose removal speed $V_A$ is shown in the lower part of the diagram, stores yarn in the cycle $Z_1$ and delivers yarn in cycle $Z_2$, then stores yarn again in the cycle $Z_3$. The speed patterns $V_A$, $V_A'$ respectively correspond to those in FIGS. 4a and 4b except that the removal speed $V_A$ is not reduced to zero at the end of picking in FIG. 5.

Figure 6:
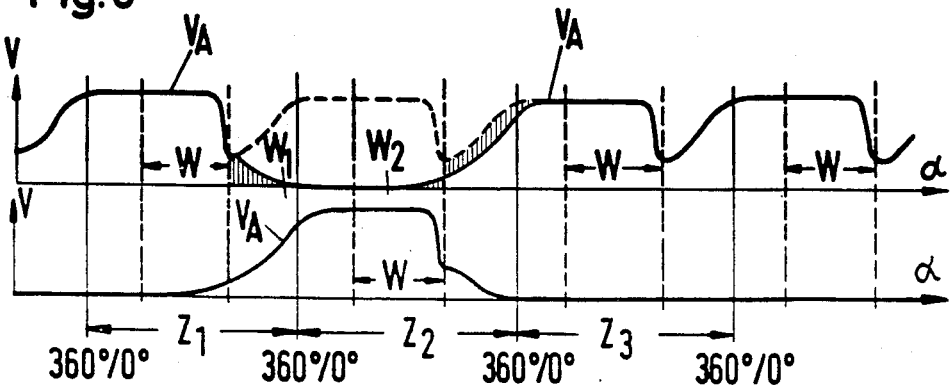

FIG. 6 shows the operation of two stores in the case of selective yarn draw-off—i.e., in the case of controlled two-picking operation. With such a situation, the order in the yarns are drawn from the respective stores need not be a simple alternation pattern (as in FIG. 5) but may be controlled to produce a variety of patterns. In this example another possible way of controlling the speed of the second winder 14 is shown. The first weft yarn store delivers yarn during the cycles $Z_1$, $Z_3$ and so on whereas the second store delivers yarn during the cycle $Z_2$, as shown in the lower part of FIG. 6. In this embodiment, in contrast to the operation described with reference to FIG. 5 weft yarn storage extends over one cycle in each case. Referring to the upper part of FIG. 6, the removal speed $V_A$ of the first store is, as hereinbefore described, reduced to a low value at the end of picking, whereafter the second winder 14 runs out as far as the loom rotation angle $W_1$. That is, after the end of the pick (as marked by the actuation of the nyarn brake 16 at the right margin of the portion W of the loom cycle), the speed of the second winder drops to zero over that portion of the loom cycle which ends at $W_1$ in FIG. 6. The winder 14 restarts at angle $W_2$ to give the removal speed $V_A$ indicated by the solid line in FIG. 6. The chain line in the upper diagram of FIG. 6 shows the speed pattern in the removal of weft yarn in the first winding zone in the first store if yarn needs to be delivered during the cycle $Z_2$. Since in the example selected the winder 14 continues to run until the angle $W_1$, the removal speed can increase more slowly from the angle $W_2$, after the starting of the second winder 14, than if the winder were to stop at the end of the picking period W.

As can be seen in the diagram in the lower part of FIG. 6, the second store is operative only for a delivery of weft yarn during the cycle $Z_2$. The speed pattern $V_A$ for weft yarn removal corresponds to the pattern $V_A$ in the upper part of FIG. 6.

Reducing the speed of yarn removal to zero as shown in the diagram in FIG. 4b results in severe stressing of the drive but is particularly gentle on the weft yarn. Reducing the speed $V_A$ to a predetermined value, as shown in FIG. 4a, with simultaneous closure of the yarn brake 16 to terminate picking, represents a compromise between the stressing of the drive 144 in the retardation of the second winder 14 and the stressing of the weft yarn 2 at the end of picking.

In conclusion, reference will be made to one possible way of operating the winder 14 at the right in FIG. 4b with a speed pattern $V_A''$. Yarn starts to be removed from the first supply by the winder 14 only at the start of the picking period W. In this case no second supply 23 forms in the winding zone 136 since the weft yarn is removed immediately into the shed 37. In this case the winder 14 must accelerate faster than in the other cases described, a requirement which calls for a very low-inertia drive 144. To obtain the required weft yarn length during a pick the number of revolutions of the winding 14 must be checked by the control facility 15 during each winding operation.

What is claimed is:

1. A method of operating a weft yarn store for feeding weft yarn for picking into a loom, the weft yarn being drawn off a package and, through the agency of a first winder, being received for intermediate storage on a drum in the form of a number of turns in a first winding zone as a first supply and being transferable by means of a second winder into a second supply in a second winding zone, characterized in that the rate of yarn removal from the first supply is reduced in accordance with a predetermined programme before the end of picking.

2. A method according to claim 1, characterized in that the rate of yarn removal is reduced steplessly to zero.

3. A method according to claim 1, characterized in that during the decrease in the rate of yarn removal, picking is terminated by the supply of yarn to the loom being blocked.

4. A method according to claim 1, characterized in that the maximum rate of yarn transfer from the first supply to the second winding zone remains constant for a period before said decrease in rate.

5. A method according to claim 1, characterized in that the rate of yarn transfer from the first supply to the second winding zone increases to a value which arises during picking in the consumption of the weft yarn shortly before exhaustion of the second supply.

6. A method according to claim 1, characterized in that before new formation of the second supply, the weft yarn is retained after the second winding zone as considered in the direction of yarn removal.

7. A method according to claim 1, characterized in that yarn removal from the first supply starts only when picking begins.

8. A method according to claim 1, characterized in that the yarn length metered for a first pick is tested in the loom and the weft yarn length to be metered for subsequent picking cycles is determined accordingly.

9. A weft yarn storage facility for receiving weft yarn from a yarn supply and for making such weft yarn available at intervals in controlled lengths to mean for inserting such lengths into a weaving shed as picks said facility comprising a storage drum having a first surface zone onto which weft yarn from said supply may be wound and unwound, first winder means for receiving yarn from said supply and winding such yarn onto said first surface zone of said drum, second winder means rotatable about said drum for unwinding yarn from said first surface zone to make weft yarn available when desired to said means for inserting lengths of weft yarn into the weaving shed, and means controlling the rotation of at least said second winder means about said drum in relation to the weaving cycle so that, near the end of each period when a length of weft yarn from the storage facility is being inserted into the weaving shed, the speed of said second winder means will be slowing and said second winder means will exert control forces on the moving weft yarn to slow down the movement of the free end of the weft yarn length before such end is brought to a complete stop.

10. A weft yarn storage facility according to claim 9, wherein said storage drum has a second surface zone, and said second winder means winds yarn onto said second surface zone, which yarn may be drawn axially off a free end of said storage drum for passage to said means for inserting lengths of weft yarn into the weaving shed.

11. A weft yarn storage facility according to claim 10, additionally comprising yarn braking means in the yarn path between said second surface zone of said drum and said means for inserting lengths of weft yarn into the weaving shed, and means for controlling said braking means in coordination with the control of said second winder means.

12. A weft storage facility according to claim 11, including means for actuating said braking means to fix a portion of said weft yarn in position relative to the end of said second surface zone nearest the free end of said drum, and wherein said braking means is actuated and said second winder means is rotated about said drum for an interval before the beginning of a weft insertion operation to cause yarn unwound form said first surface zone of said drum to be wound onto said second surface zone, wherein means are provided to cause a weft insertion operation to begin concurrently with deactivation of said braking means, and wherein said braking means is again actuated after said second winder means has slowed down the movement of the free end of the weft yarn length inserted into the shed.

13. An air jet loom comprising a yarn storage facility according to claim 9, wherein the control forces exerted by said second winder means serve to decrease the speed of the inserted length of weft yarn sufficiently gradually to avoid high tensile stress in the yarn at the end of the insertion operation.

14. A weft yarn storage facility according to claim 9, including drive means for at least the second winder means that can be programmed for commencement time and for speed and that comprises a controlled electric motor and an associated control facility.

15. A weft yarn storage facility according to claim 14, including drive means for driving said first winder means independently of said second winder means.

16. A weft yarn storage facility according to claim 14, wherein said electric motor comprises a ring surrounding said drum and having electric windings, a rotor guided in said ring and having a magnetic insert, and a yarn guide carried by said rotor and being adapted to rotate along the ring around the drum.

17. A weft yarn storage facility according to claim 9, wherein said first and second winder means are interconnected for concurrent rotation about said drum.

* * * * *